US005297772A

United States Patent [19]

Stefanick

[11] Patent Number: 5,297,772

[45] Date of Patent: Mar. 29, 1994

[54] IMPROVEMENTS ON MOLDS FOR MAKING COMPOSITE BLOCKS

[76] Inventor: William F. Stefanick, 15 Torrance Road, Apartment 1606, Scarborough, Ontario, Canada, M1J 3K2

[21] Appl. No.: 840,098

[22] Filed: Feb. 24, 1992

[51] Int. Cl.[5] ..... B28B 7/00

[52] U.S. Cl. ..... 249/102; 249/119; 249/129; 249/160; 249/168; 425/183; 425/468

[58] Field of Search ..... 249/102, 119, 122, 129, 249/131, 160, 163, 168; 425/183, 195, 254, 425, 432, 434, 451.9, 452, 456, 468

[56] References Cited

U.S. PATENT DOCUMENTS

| | | | |
|---|---|---|---|
| 503,667 | 8/1893 | Mowry | 249/129 |
| 1,166,312 | 12/1915 | Barten | 249/129 |
| 1,458,551 | 6/1923 | Seat | 249/129 |
| 1,574,597 | 2/1926 | Bocchino | 425/195 |
| 1,688,627 | 10/1928 | Long | 425/468 |
| 1,975,330 | 10/1934 | Martin et al. | 249/119 |
| 3,128,522 | 4/1964 | Benjey et al. | 425/452 |
| 4,050,865 | 9/1977 | Drostholm et al. | 425/183 |
| 4,218,206 | 8/1980 | Mullins | 425/452 |
| 5,062,610 | 11/1991 | Woolford et al. | 249/119 |

FOREIGN PATENT DOCUMENTS

| | | | |
|---|---|---|---|
| 154434 | 3/1982 | German Democratic Rep. | 249/102 |

*Primary Examiner*—Charles S. Bushey

[57] ABSTRACT

A mould bar frame for making composite blocks has mould bars for supporting a plurality of individual moulds side by side. Each individual mould has end core liners at each end and divider plates both liners and plates cooperating with the mould bars. The end core liner may be made of two separable elements one of which is reversible to reduce wear. A plurality of lugs on each end of a divider wall ride in corresponding grooves in the mould bars to reduce wear.

4 Claims, 6 Drawing Sheets

IMPROVEMENTS ON MOLDS FOR MAKING COMPOSITE BLOCKS

This invention relates to improvements in the construction of moulds for making concrete blocks and other types of composite blocks using cementitious material.

Such blocks are moulded in moulds comprising a pair of parallel mould bars defining between them a longitudinally extending space for a plurality of individual moulds, arranged side-by-side. Divider walls separate the individual moulds. The end dividers walls are supported by tie bars, extending between the moulds while end core liners form the end walls of individual moulds.

A plate or pallet ('pallet' hereafter) extending longitudinally below and along the mould frame forms the bottom wall of the individual moulds. It will be noted that the mould bar maintains the divider and end core liner walls in their desired relationship to each other and to the bottom plate. However it is noted that none of the side, end or bottom mold members is fixedly attached to the other. The reason is that the individual moulds, arranged side by side along the mould bars, are of constant height and length (measured transversely of the mould frame) but may be of differing widths as determined by the width of the end core liners which act as spacers for the divider walls.

To the moulds as above described there are provided cores to provide the apertures in the blocks, means for feeding the mixture of cement and aggregate into the mould while vibrating it and means for pressing the cement and aggregate once in the mould.

However the invention is principally concerned with the dividers and end core liners and their relationship to the mould bar, the mould bar frame and the pallet.

The end core liner, forms the end wall of the mould, the spacer for the dividing walls and determines the contour of the ends of the block. It has heretofore been made as one piece. Thus when the end core liner wore out, the entire end core liner had to be replaced at material expense.

This invention provides an end liner performing the spacing and some of the shaping functions for the block with a separate end core which performs other of the shaping functions. The end liner is shaped for its purposes on both sides so that it is reversible. Thus the life of the end liner is doubled because of the two piece end core liner and the reversibility of the liner component.

In prior constructions the divider plates have been keyed by a lug to a single groove in the mould bars. Although the lug served to anchor the divider against removal it tended to allow vibratory pivotting about the lug under vibration of the mould, reducing the precision of the blocks produced.

This invention, in one aspect, provides a plurality of grooves in the mould bars and complementary lugs on the divider plates. The provision of two or more lugs sharply reduces the development of looseness under divider plate vertical vibration.

In another aspect of the invention the divider plate is provided with a lug at each end which goes below the adjacent mold bar and contacts its lower surface. Such lug also acts to reduce the development of looseness under vibration.

In a preferred version of the invention the divider plate has a lug at each end which goes below the adjacent mould bar and contacts its lower surface, such lug is provided with a, preferably detachable downward extension. The inward edges of these downward extensions are located and dimensioned to contact adjacent side edges of the pallet, so that the edges act as stops to prevent migration of the mould and mold bar relative to the pallet in directions perpendicular to the longitudinal axis of the mould bar frame.

(The mould bar frame encloses a number of side by side individual moulds. As a result the longitudinal dimension of the mould bar frame is perpendicular to the longitudinal dimension of individual moulds).

In a preferred aspect of the invention the two part end core liner has an end liner cut away along its bottom edge over an extent to be covered on the inside by the end core. The combined end core and liner, in accord with this aspect of the invention provide an outwardly facing lower niche in which loose particles or lumps of aggregate found on the pallet, may collect during the vibration of the members. The niche allowing such collection thus lowers the likelihood that such particles or lumps may collect below the end core liner which would create an unwanted spacing between the mould end and side walls, on the one hand, and the pallet on the other hand, which would tend to introduce irregularity into the shape of the resulting block.

In a preferred aspect of the invention the mould bars are provided with a lower surface which is contacted by the upper edge of a lug projecting outwardly from a divider plate. The lower surface may be provided by adding a detachable wear strip of harder material to the under surface of the integral part of the mould bar. In such arrangement the wear strip accepts the wear which would otherwise wear the more complex and expensive mould bar itself. Thus a worn wear strip may be replaced many times without replacement of the mould bar. The selection of the lower mould bar surface for the installation of such wear strip is of some importance. The upper surfaces of mould bar grooves, contacted by divider plate lugs would also benefit from the use of a wear strip. However in the latter locations, the provision of a wear strip would imply widening of the grooves and consequent weakening of the mould bar, hence it is unwise to do this.

In a preferred aspect of the invention, there is provided a keying member designed for mounting in a mould bar groove, to project inwardly therefrom and with the inward projection defining upper and lower substantially horizontal surfaces. The sided edges of the divider plate are contoured in a complementary manner to make edge to edge contact with the upper and lower edges. It may also be a hardened and relatively small member, designed to last the life of three or four divider plates. The use of the keying member reduces costs of the (then) smaller divider plates providing an overall saving in the day to day costs of the mould operation.

In a preferred aspect of the invention there is provided a hanger bar adapted to extend between said mould bars and over said mould bars for attachment thereto. The hanger bar is provided with means to attach to and suspend a divider plate. This provides a useful and advantageous alternative to the lug and groove method of mounting the divider plates.

Other features and advantages of the invention will be described in the description of the preferred embodiment.

BRIEF DESCRIPTION OF THE DRAWINGS

In drawings which illustrate a preferred embodiment of the invention.

DETAILED DESCRIPTION OF THE PREFERRED EMBODIMENT

The mold frame, individual mould members described herein, except where otherwise noted, are usually made of steel although other metals may be used.

Figure 1:
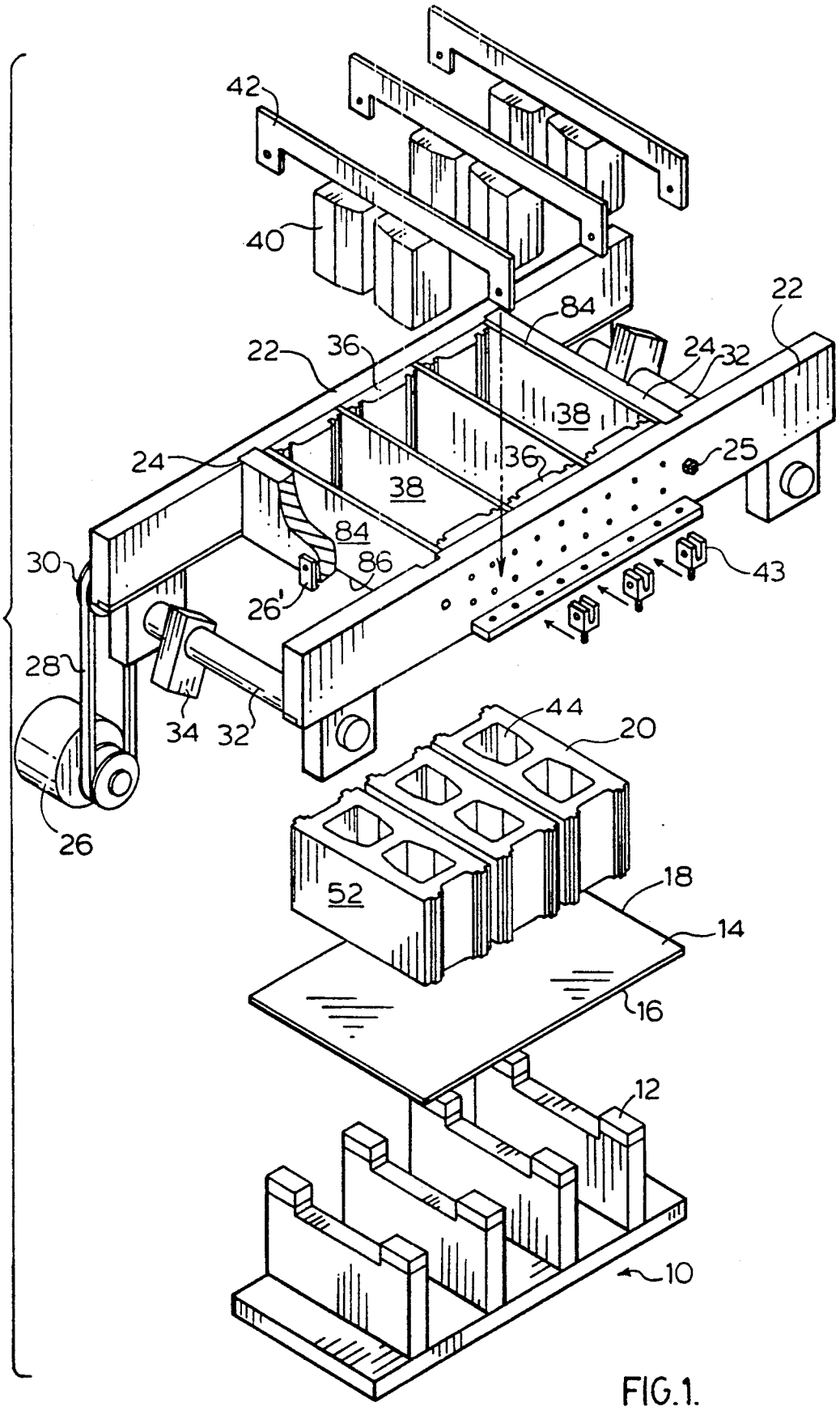
FIG. 1 is an exploded perspective view of part of a mould apparatus in accord with some features of the invention.

In FIG. 1 is shown a stand 10 which will include rubber pads 12 to support the elements to be discussed, as they vibrate. A rectilinear plate or pallet ('pallet' hereafter) 14 has parallel side edges 16 and end edges 18. Blocks 20 are examples of products which would be moulded by the equipment shown. A mould bar frame comprises parallel spaced mould bars 22 which are fastened by bolts 25 to tie bars 24 to form, a rigid frame. The nearer bar 24 is broken away. It is noted that the tie bars include hooks 26' to prevent translation, under vibration, of the mould bar frame longitudinally relative to the pallet. Vibrating means for the frame are schematically shown as motor 26, by contacting the pallet edge belt 28, pulley 30 shaft 32 rotatably mounted in bearings on the mould bars and eccentric 34 rotatable with shaft 32. Shaft 32 is rotatably mounted in the mould bars. The drive for remote shaft 32 is omitted for clarity. It will be noted that the mould bar 22 spacing determines the length of individual moulds. It will be noted that the tie bar 24 spacing determines the accumulated widths of a number of individual moulds arranged side by side. Thus the width of individual molds is determined by the end core liners 36 which will act as spacers for the individual mould divider walls 38. Although not shown it will be noted that either the tie bars are made adjustable in spacing or special spacing members used so that the longitudinal sum of the divider wall thicknesses and end core liner widths and special spacers (if necessary) fills the space between the tie bars. The divider walls 38, end core liners 36 and cooperating aspects of the tie bars will be described in detail hereafter. Cores 40 are suspended on core hanger bars 42 which in turn are attached to the tie bars, as schematically shown at 43, so that the cores rest in the individual moulds and shape the individual apertures 44 in the blocks.

Parts having a similar (main) functions and differing features are denoted by the same number and a different letter. (Thus differing divider walls are 38, 38A, 38B etc.)

Figure 2:
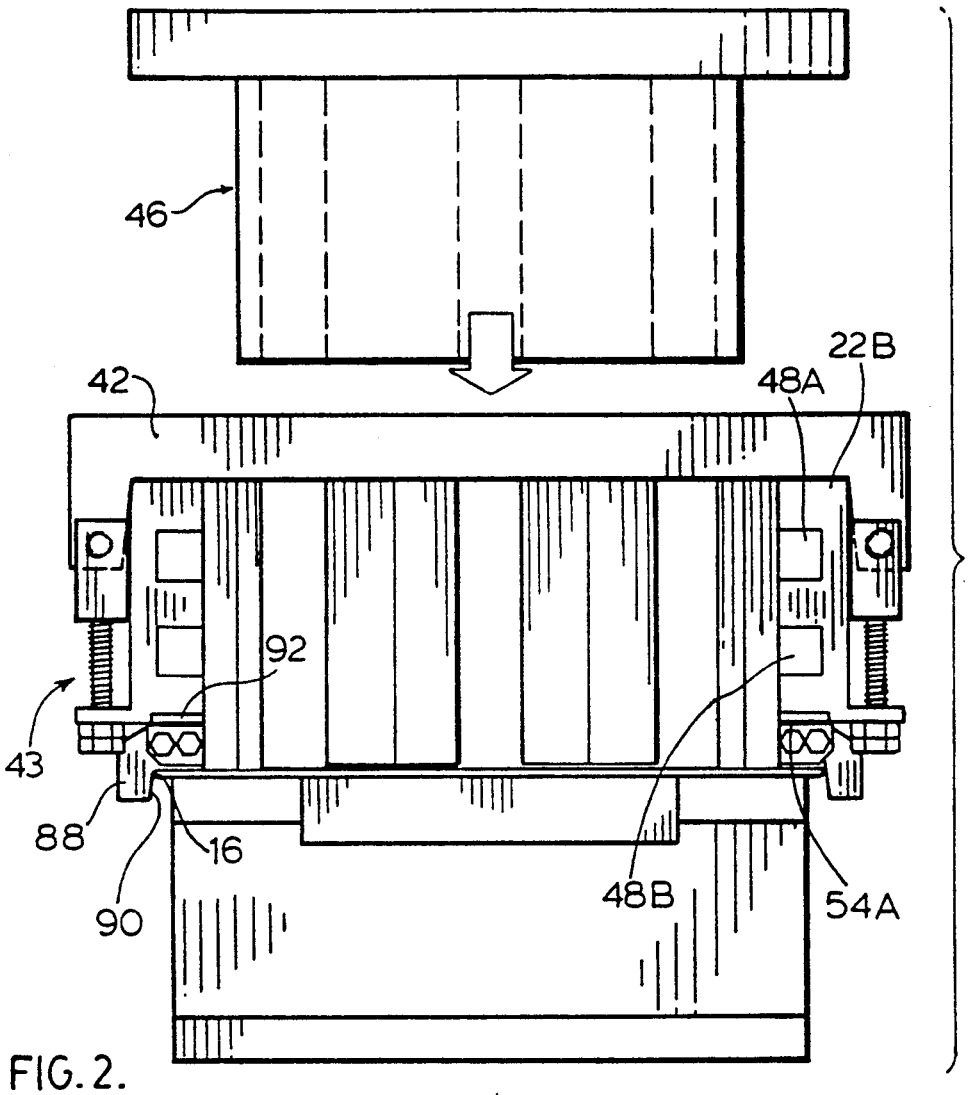
FIG. 2 is a partially schematic view of a mould apparatus in accord with some features of the invention.

As demonstrated in FIG. 2, with reference back to FIG. 1, the mould frame formed by mould bars 22B and tie bars 24 with selected individual mould dimensions and cores in place is filled with any desired type of cementitious aggregate by means not shown, while vibration consolidates the aggregate in the mould. A presser 46 is shaped to pass downwardly, outward of the cores and inward of the end core liner and dividers to further compact the aggregate which then sets to its final form.

Figure 3:
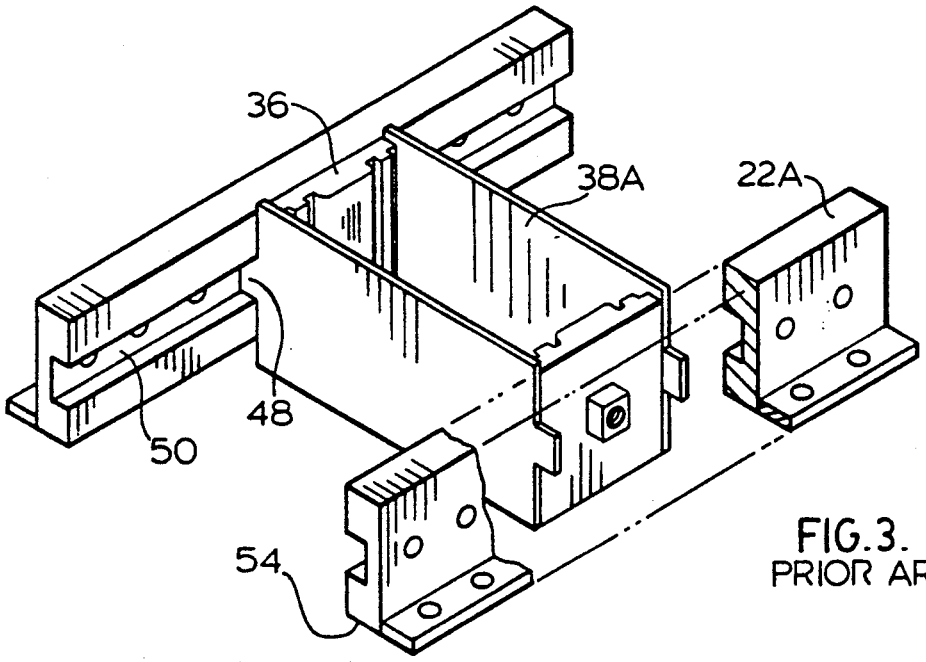
FIG. 3. PRIOR ART
FIG. 3 shows the prior art arrangement of mould bars, divider plates, and end core liners.

FIG. 3 shows the customary prior art arrangement of the divider walls 38A, end core liners 36 and mould bars 22A. It will be noted that the end core liner 36 is a single member so that when wear destroys its contour it must be entirely replaced. It will be noted that the divider walls 38A have single lugs 48 riding in single tie bar grooves 50 which will cause the dividing walls 38A to have after wear a relatively looseness under vibration, tending to degrade the contour of the block side walls 52. It will be noted that the divider walls 38A have no restraining contact with the lower surface 54 of the mould bar walls, increasing the relative vibratory motion of the divider walls. It will be noted that there is no provision for limiting relative translating motion of the mould frame dividers 38A and end core liners 36 relative to the pallet in the direction transverse to the mould bars.

Figure 4:
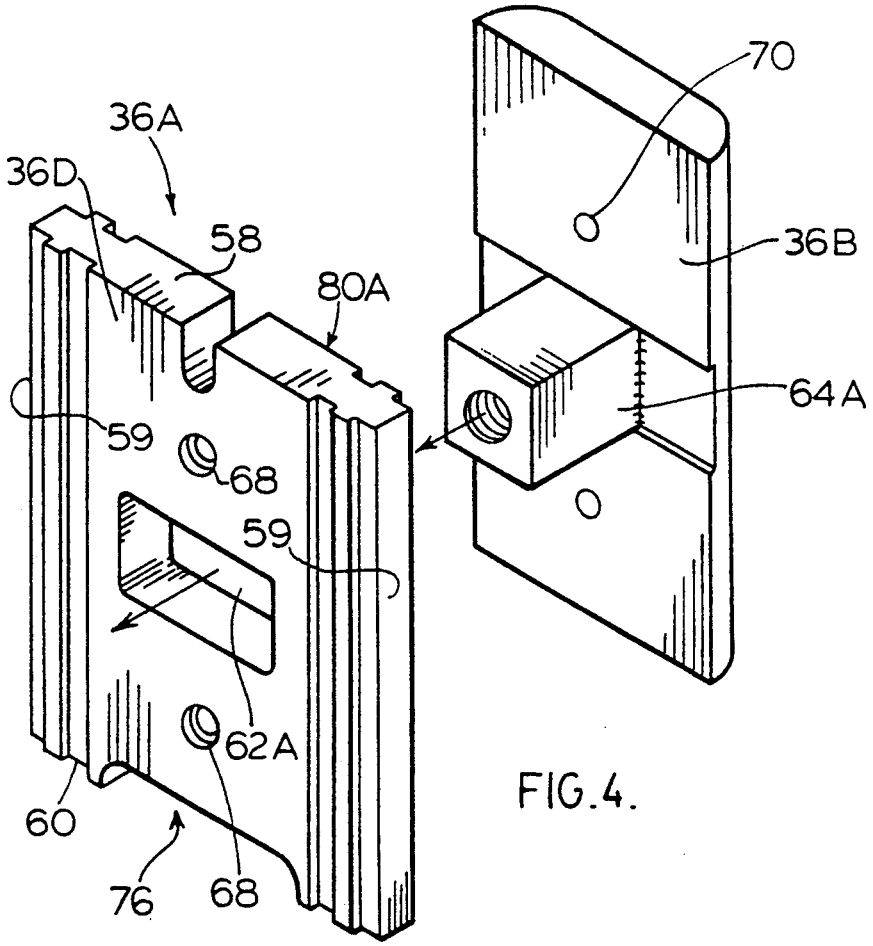
FIGS. 4 and 5 are perspective views of an end core liner in accord with the invention.
Figures 5, 6:
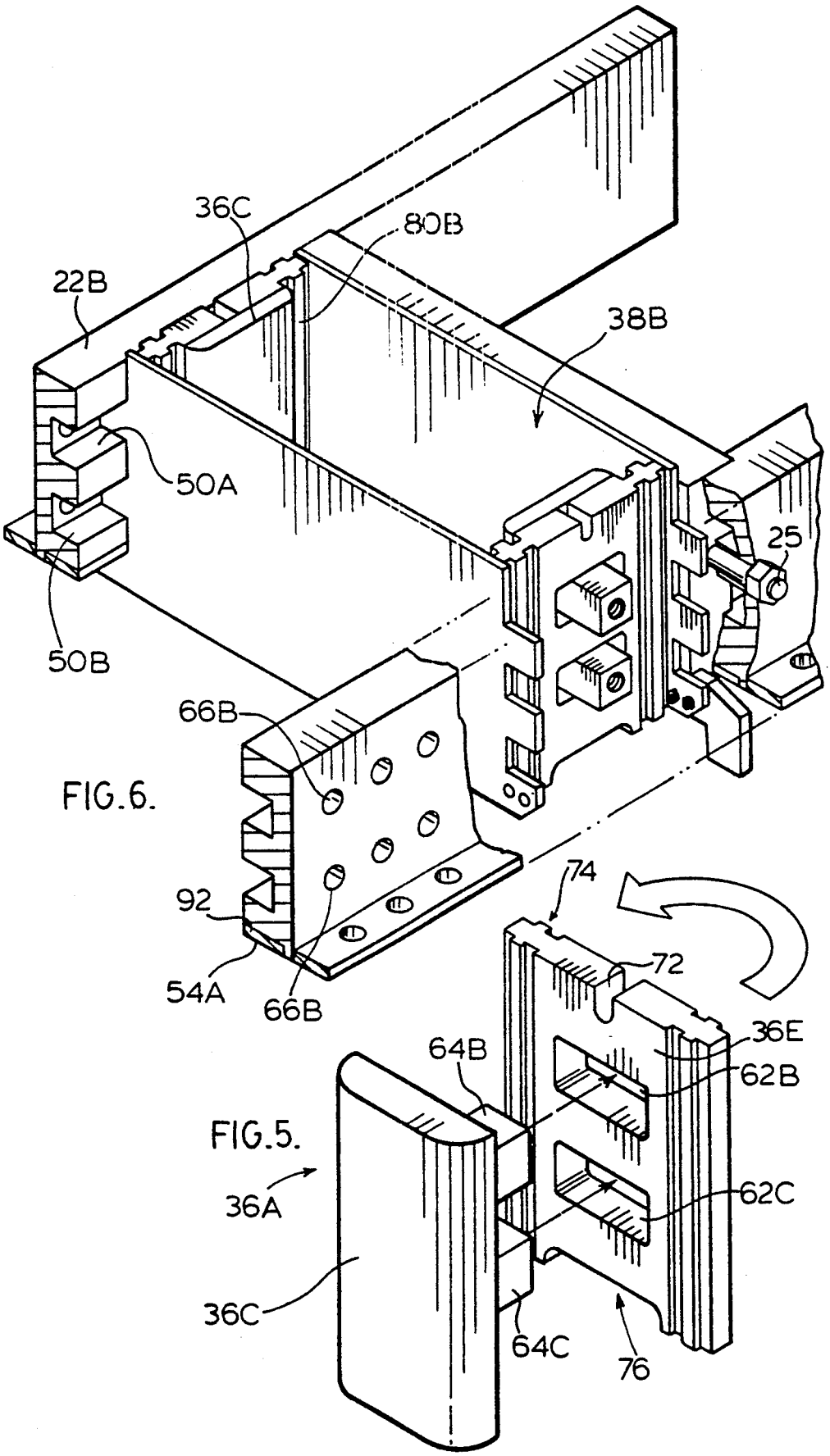
FIG. 6 shows a construction of end core liners, divider walls and mould bars in accord with the invention, FIG. 7 demonstrates the provision of a wear strip in accord with the invention, FIG. 8 demonstrates the cooperation between divider wall lugs and the lower surface of the mould bar in accord with the invention, FIG. 9 demonstrates the provision of a hanger bar for suspending the divider plates, FIG. 10 demonstrates the cooperation of divider wall lug extensions and a pallet in accord with the invention, FIG. 11 demonstrates the cooperation between mould bar T inserts and a complementary shaped divider plate in accord with the invention.

FIGS. 4, 5 and 6 demonstrate the construction of an end core liner in accord with the invention. The end liner 36D or 36E is symmetrical about its median plane so that it can turn either face toward the inside.

Figure 7:
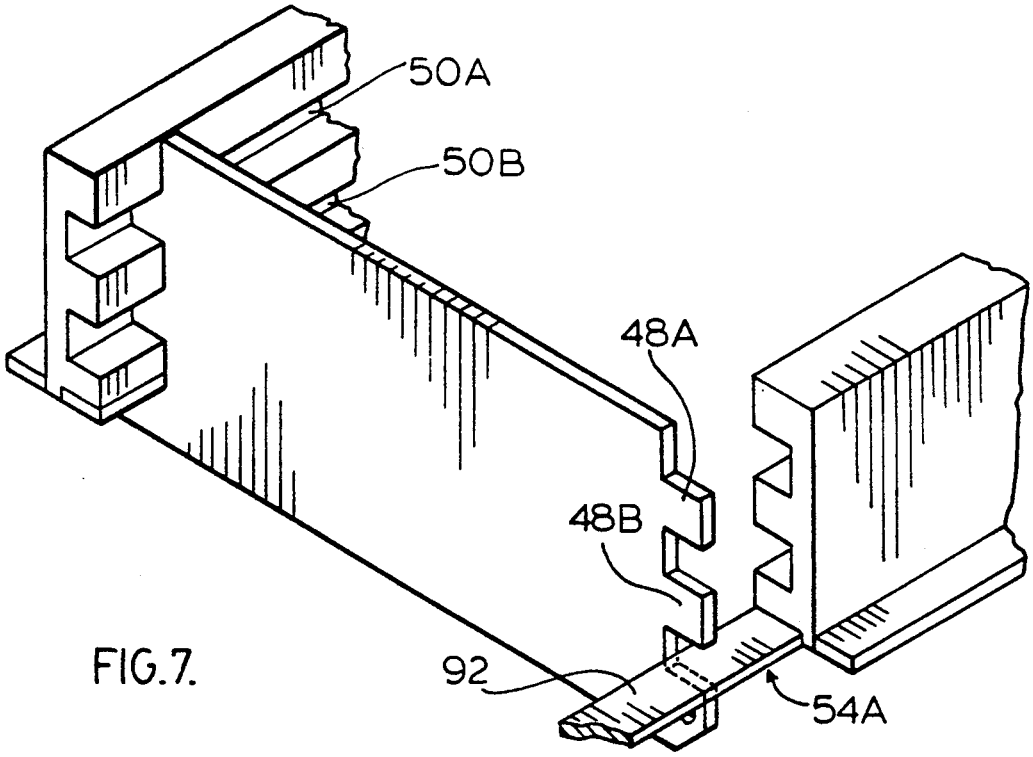
Figure 8:
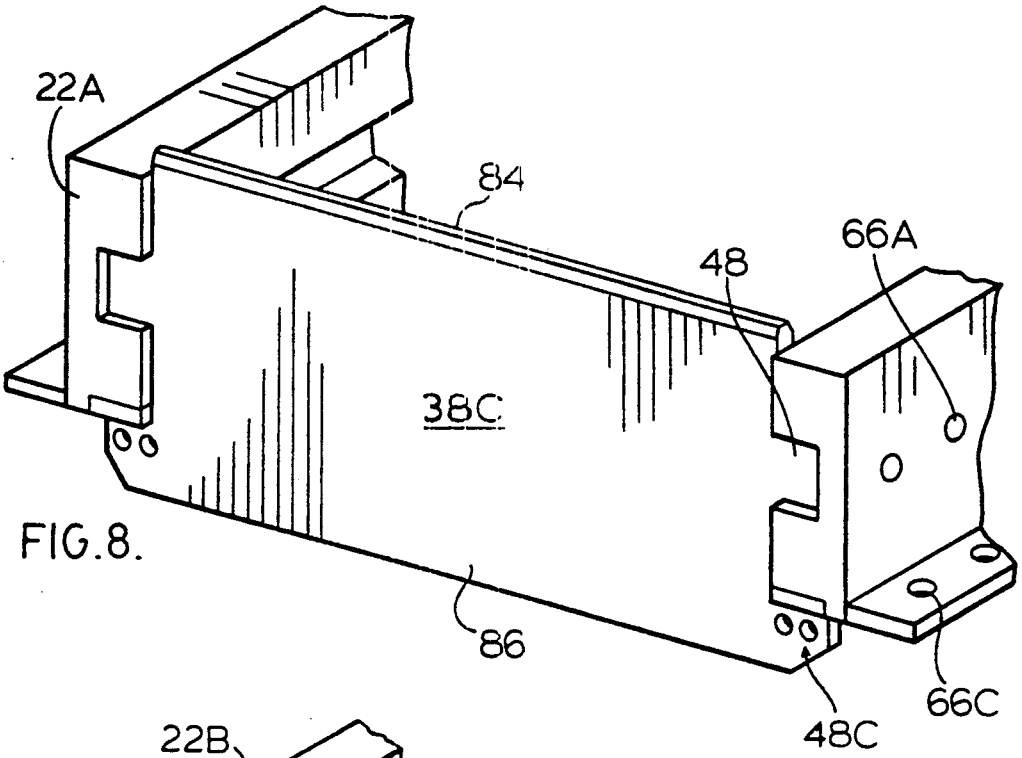

Side edges 59 define the width of the block and act to bear on and space divider walls 38, 38A or 38C of an individual mould. The end liner 36D provides a rectilinear inner aperture or apertures 62A, (FIG. 4) or 62B and 62C (FIGS. 5 and 6) to allow passage of the shank 64A (FIG. 4) or shanks 64B, 64C (FIGS. 5 and 6) from end core 36B or 36C respectively. The separate end liner 36D, or 36E is held in place by the shank or shanks 62A (liner 36D) or 62B and 62C (liner 36E) which shank or shanks bolted to the mould bars 22 (FIG. 1), 22A (FIG. 3) or 22B (FIG. 9) by bolts not shown. FIG. 4 shows an end liner 36D with a single aperture 62A to combine with a single end core 36B. The FIG. 4 alternative would be used with mould bars having a single groove 50 as shown in FIGS. 3 and 8 and the tie bar shanks 64A would be bolted by bolts not shown in selected apertures 66A in the tie bars. FIGS. 5 and 6 show end liners with two apertures 62B, 62C to receive cores 36B with two shanks 64B, 64C for bolting to mould bar 22B with double grooves 50A, 50B as shown in FIGS. 1, 2 and 7 by bolts attached through apertures 66B. Above and below the large apertures 62A, 62B the liner may be provided with small apertures 68 in case it is desired to bolt the end liner to end core 36B or 36C at threaded apertures such as 70 (FIG. 4).

The end liner 36B or 36E is preferably provided with an upper transverse central groove 72 to receive the lower edge of core suspender bar 42 and ensure the registration of these members. The end liner 36D (or 36E) carries any keying grooves such as 74 with which it is desired to ornament the finished block. The contour of the end core 36C is likewise selected to produce the desired intaglio shaping ly the end of the moulded block. The lower edge of the end liner 36D or 36E preferably has a cut away arch 76 centrally located. The dimensions of the cut away portion are such that it is inwardly covered by the end core 36B or 36C so that the presence of the cut away portion does not affect the contour of the finished block. However the cut away portion 76 plus the surface of end core 36C (or 36B) form a downwardly and outwardly facing niche which provides a collection area for loose aggregate on the vibrating pallet and reduces the risk that such aggregate will get between the end core liner and the pallet reducing the integrity of the mould. The symmetry of the end liner 36 or 36E about its median plane, allows its reversal, once the inner face 80A (FIG. 4) 80B (FIG. 6) becomes worn to provide a fresh face for the mold. The innovation thus provided almost doubles the working life of the end liner.

As FIG. 3 demonstrates it is customary to provide mould bars with a single rectilinear groove 50 shaped to slidably receive lugs 48 on dividing plates 38A. The single groove 50 and lug 48 allows with wear the introduction of looseness of the divider plates. In accord with this invention the dividf-- plates are provided with two lugs 48A, 48B as shown in FIGS. 2, 6 and 7 which ride in two mould bar grooves 50A, 50B of complementary section. The provision of two grooves materially reduces looseness in a vertical direction of the divider plates relative to the end core liner, improving the integrity of the mould. As demonstrated in FIGS. 1, 2, 6, 7, 8, 10 the divider plate may also be provided with a lug 48C shaped to provide an upper edge 82 which contacts the lower surface 54 or 54A of each mould bar. This arrangement further reduces the rotary component of the divider plates 38B, 38C, 38D and the anchoring, during vibration of the divider wall relative to the mould bar.

FIG. 8 demonstrates the use of a divider plate 38C with a lug 48 for riding in a single grooved tie bar 22A (as shown in FIG. 8). A second lug 48C projects outwardly from the divider wall to provide the upwardly facing edge contacting on the lower surface 54 of the mould bar as discussed and with the advantages as described in the previous paragraph.

In general, and in each application the upper and lower edges of 84 and 86 of the divider wall determine the upper and lower limits of the mould cavity.

Figure 10:
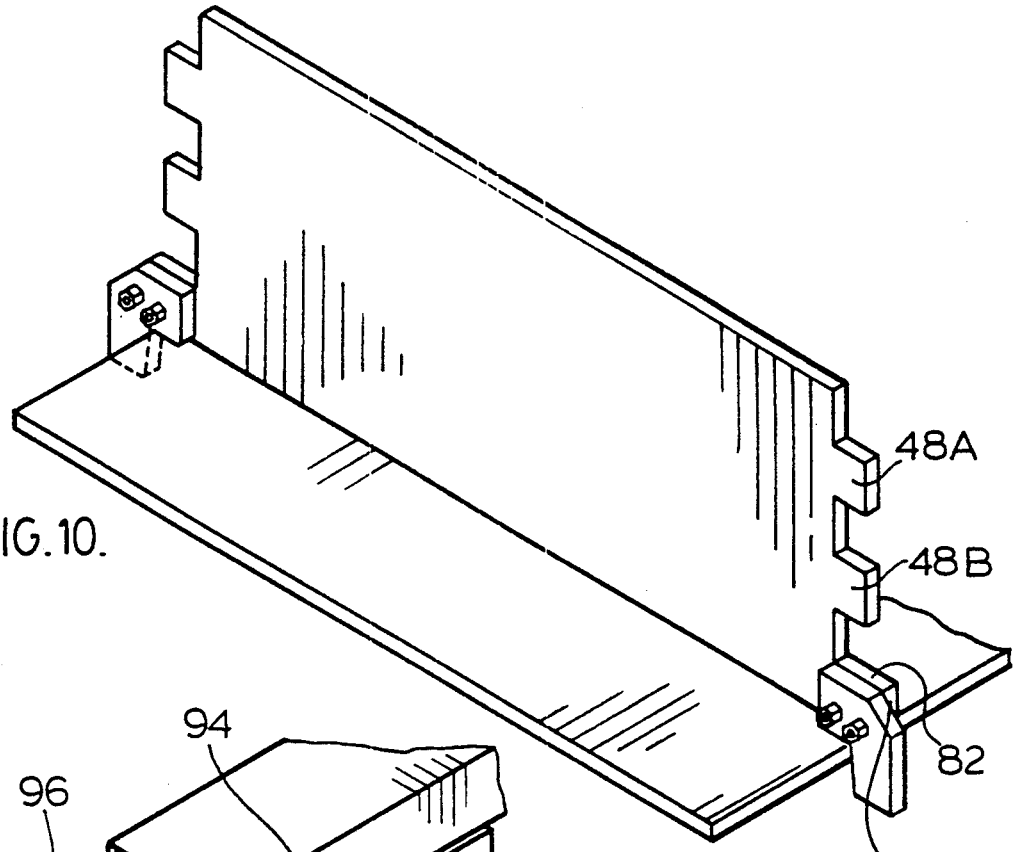

In the aspect of the invention shown in FIGS. 2, 6 and 10 the outwardly extending lug is bolted to a downwardly extending extension 88 which has an inwardly facing edge 90 designed to ride on the side edges 16 of pallet 14 and prevent migration transverse to the longitudinal direction of the mould bar frame during the vibrating process. The extensions 88, if desired, may of course be formed as an integral extension of the divider plate, if desired.

A further feature of the invention is demonstrated in FIGS. 2, 7 and 8 where the lower surface 54A of the mould bars is provided by a wear strip 92 detachably attached (by any conventional means not shown) to the mould bar . Strip 92 endures the functional wear of the upper surface of lug 48C . The wear strip 92 may be made of specially hardened steel and avoids wear to the mould bars proper thus extending the life of the latter many times.

Figure 11:
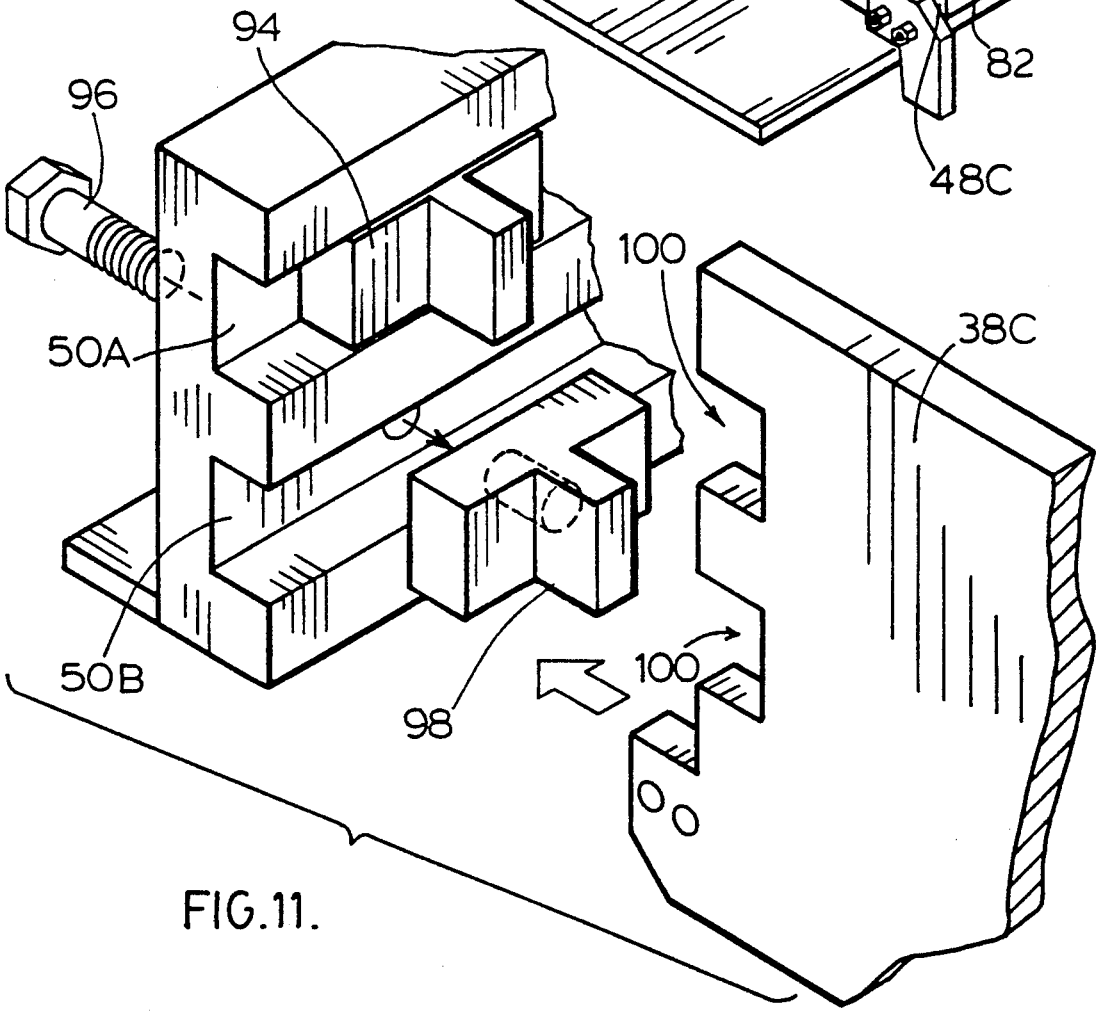

FIG. 11 demonstrates a further feature of the invention. For each groove 50, 50A, or 50B in the opposed mould bars there is provided a T-shaped keying member with the rectilinearly contoured cross-bar 94 of the T-shaped to slide in the mould bar groove 50, 50A or 50B and attachable thereto by bolts 96 at locations corresponding to those of the divider walls. The upright 98 of the T extends inwardly of the innermost surfaces of the mould bars to rest in complementary shaped notches 100 of the divider wall. Thus upper and lower horizontal profile of the upright 98 (as viewed parallel to the mould bars) contacts corresponding defining edges of notch 100. It will be noted that the width of T uprights 98 is that of divider plates 38C. The reduction in material in the divider walls produced by the inwardly extending notches 100 in comparison to outwardly extending lugs provides a considerable saving in cost. The T inserts may be made of specially hardened material adapted to have approximately triple the life of a divider plate thus enhancing the cost saving due to the consequently reduced divider plate area.

Figure 9:
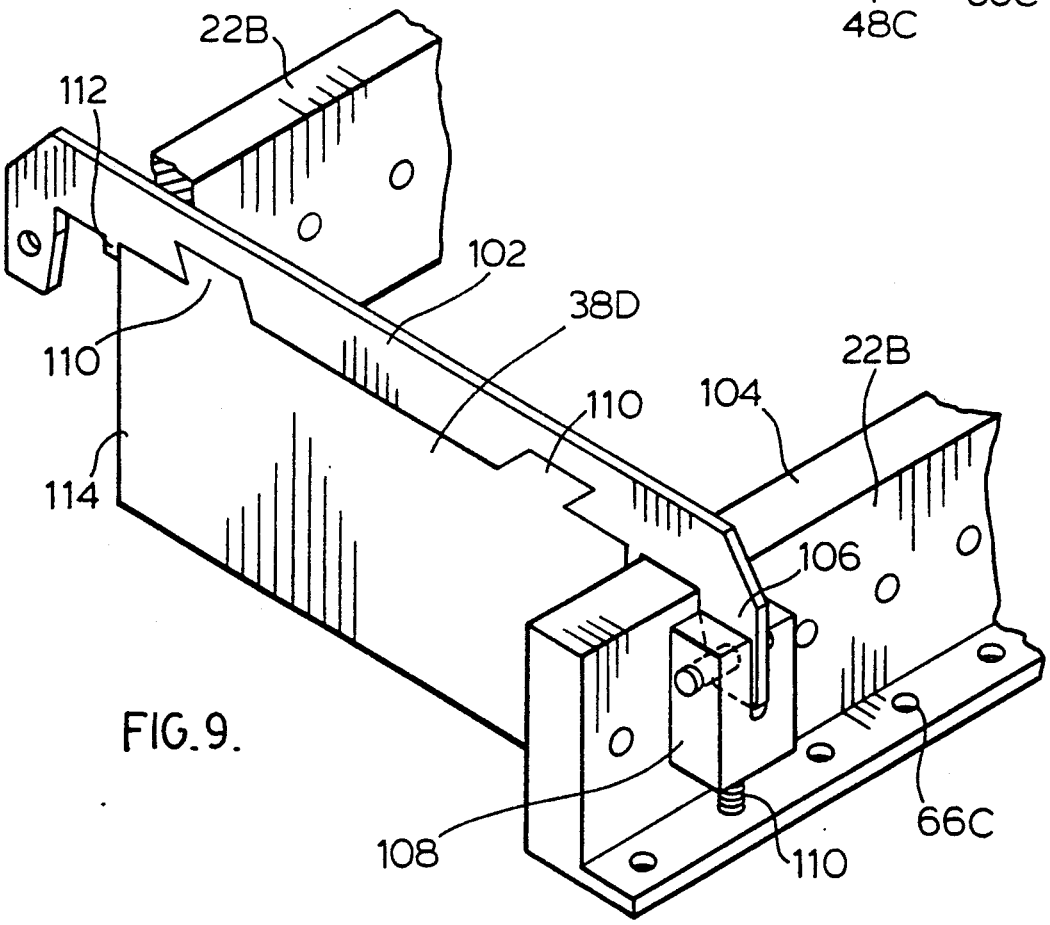

FIG. 9 demonstrates a further feature of a preferred aspect of the invention. As shown the mould bars 22B are not grooved or, if grooved, are so only for attachment of the end core liners 36, 36A. The divider plate 38D is provided with straight side edges 114. A suspension bar 102 extends between the mould bars and rests on the upper surfaces 104 of the mould bars. Downward extensions 106 outwardly of the bars allow attachment to apertures 66C in the mould bars by pivot blocks 108 and bolts 110. The suspension bar 102 is provided with interlocking means complementary to the shape of the upper edge of the divider wall, to allow suspension of the divider wall. In the preferred embodiment, the interlocking means takes the form of diverging rectilinear notches in the suspension bars which receive complementary tabs 110 of the divider wall. Tabs 112 extending downwardly from the suspension bar are designed to contact the outer edges 114 of the divider walls. This results in a small inward spacing of the side edges 114 of the divider wall from the mould bars 22, 22A, 22B. However this does not affect the integrity of the mould cavity because of the thickness of the end core liner. Although the divider wall 38D is preferably slidably received in the suspension bar such alignment may be maintained because the location of the divider wall is determined by spacing means inside the mould frame as previously discussed.

I claim:

1. Mould for making composite blocks having:

mould bar frame including opposed mould bars, arranged to support a plurality of individual moulds side-by-side, pairs of end core liners arranged in opposition each attached to one of the mould bars, each pair corresponding to an individual mould of said plurality, divider plates extending between corresponding side edges of adjacent end core liners, wherein an opposed pair of said end core liners and the divider plates on each side thereof form individual side walls of the mould, wherein a pallet is arranged to contact lower edges of said divider plates and end core liners to form a bottom of said mould, each end core liner including an end liner extending between said divider plates, an aperture in said end liner, an end core designed to rest against an inner face of the end liner, provided with a shank designed to extend through said aperture, means for attaching said shank to said mould bar, said end core and end liner being adapted, when said shank is attached to said mould bar, so that said end core and inwardly exposed surfaces of said end liner, will shape an end face of a block in said mould, said end liner being adapted to have either face turned toward said mould.

2. Mould bar as claimed in claim 1 wherein a central extent of a lower edge of said end liner is cut away to form an arch of width less than the width of said end liner whereby said end core overlies said arch.

3. Mould for making composite blocks having:

mould bar frame including opposed mould bars, arranged to support a plurality of individual moulds in side-by-side arrangement, pairs of end core liners arranged in opposition each attached to one of the mould bars, each pair corresponding to an individual mould of said plurality, divider plates extending between corresponding side edges of, adjacent end core liners, wherein an opposed pair of said end core liners and the divider plates on each side thereof form individual side walls of the mould, wherein a pallet is arranged to contact lower edges of said divider plates and end core liners to form a bottom of said mould, at least one groove running longitudinally of an inside face of each said mould bar, a keying member attached to each mould bar corresponding to each divider plate located in said groove and projecting out of said groove, inwardly in relation to said mould bar frame to define a profile having upper and lower substantially horizontal surfaces viewed along the mould bar, side edges of each divider being shaped to receive a projecting portion of said keying member and to make edge to edge contact with, respectively, said upper and lower surfaces.

4. Mould for making composite blocks having:

mould bar frame including opposed mould bars, arranged to support a plurality of individual moulds in side-by-side arrangement, pairs of end core liners arranged in opposition each attached to one of the mould bars, each pair corresponding to an individual mould of said plurality, divider plates extending between corresponding side edges of adjacent end core liners, wherein an opposed pair of said end core liners and the divider plates on each side thereof form side walls of an individual mould, wherein a pallet is arranged to contact lower edges on said divider plates and end core liners to form a bottom of said mould, means providing a space between a lower surface of said mould bars and said pallet, said divider plates being provided adjacent each mould bar with an edge contacting an inside surface of the adjacent mould bar, and an outwardly extending lower lug being shaped to extend under each said mould bar and provide an edge contacting an upper surface of said pallet, wherein at extension of said lower lug extends downwardly providing an inner surface contacting an edge of said pallet.

* * * * *